US011643613B2

(12) United States Patent
E et al.

(10) Patent No.: US 11,643,613 B2
(45) Date of Patent: May 9, 2023

(54) GREASE COMPOSITION INCLUDING COPPER SULFIDE FOR CONSTANT VELOCITY JOINTS

(71) Applicant: GKN Driveline International GmbH, Lohmar (DE)

(72) Inventors: Jisheng E, Hennef (DE); Christoph Lindlahr, Bonn (DE); Mario Witzdam, Hennef (DE)

(73) Assignee: GKN Driveline International GmbH, Lohmar (DE)

( * ) Notice: Subject to any disclaimer, the term of this patent is extended or adjusted under 35 U.S.C. 154(b) by 0 days.

(21) Appl. No.: 17/637,693

(22) PCT Filed: Sep. 18, 2019

(86) PCT No.: PCT/EP2019/075038
§ 371 (c)(1),
(2) Date: Feb. 23, 2022

(87) PCT Pub. No.: WO2021/052578
PCT Pub. Date: Mar. 25, 2021

(65) Prior Publication Data

US 2022/0290068 A1 Sep. 15, 2022

(51) Int. Cl.
*C10M 169/00* (2006.01)
*C10M 105/06* (2006.01)
(Continued)

(52) U.S. Cl.
CPC ..... *C10M 169/00* (2013.01); *C10M 105/06* (2013.01); *C10M 107/02* (2013.01);
(Continued)

(58) Field of Classification Search
CPC . C10M 111/04; C10M 169/00; C10M 117/02; C10M 135/18; C10M 105/06;
(Continued)

(56) References Cited

U.S. PATENT DOCUMENTS 2,790,776 A * 4/1957 Peterson ..... C10M 5/00 507/140
5,670,461 A 9/1997 Schreiber et al.

FOREIGN PATENT DOCUMENTS

CN 109777554 A 5/2019
GB 742547 * 5/1953
(Continued)

OTHER PUBLICATIONS

International Search Report and Written Opinion for PCT/EP2019/075038 dated Apr. 30, 2020 (9 pages).

*Primary Examiner* — Vishal V Vasisth
(74) *Attorney, Agent, or Firm* — Bejin Bieneman PLC

(57) ABSTRACT

A grease composition is intended primarily for use in constant velocity joins (CV joints), especially ball joints and/or tripod joints, which are used in the drivelines of motor vehicles. The grease composition for use in constant velocity joints comprises at least one base oil, and least one thickener, at least one copper sulfide in an amount of approximately 0.01 wt-% up to approximately 1.5 wt-% of the grease composition, molybdenum disulfide and/or at least one phosphorus-free organic molybdenum complex in an amount of approximately 0.1 wt-% up to approximately 5.0 wt-% of the grease composition. Further, a constant velocity joint comprises the grease composition.

17 Claims, 4 Drawing Sheets

(51) Int. Cl.

| | |
|---|---|
| ***C10M 107/02*** | (2006.01) |
| ***C10M 111/04*** | (2006.01) |
| ***C10M 117/02*** | (2006.01) |
| ***C10M 125/22*** | (2006.01) |
| ***C10M 135/18*** | (2006.01) |
| ***C10M 141/08*** | (2006.01) |
| ***C10M 159/00*** | (2006.01) |
| ***C10M 163/00*** | (2006.01) |
| *C10N 40/04* | (2006.01) |
| *C10N 30/10* | (2006.01) |
| *C10N 50/10* | (2006.01) |

(52) U.S. Cl.
CPC ..... *C10M 111/04* (2013.01); *C10M 117/02* (2013.01); *C10M 125/22* (2013.01); *C10M 135/18* (2013.01); *C10M 141/08* (2013.01); *C10M 159/00* (2013.01); *C10M 163/00* (2013.01); *C10M 2201/066* (2013.01); *C10M 2203/065* (2013.01); *C10M 2205/0206* (2013.01); *C10M 2207/1265* (2013.01); *C10M 2219/068* (2013.01); *C10N 2030/10* (2013.01); *C10N 2040/046* (2020.05); *C10N 2050/10* (2013.01)

(58) Field of Classification Search
CPC ..... C10M 141/08; C10M 107/02; C10M 159/00; C10M 163/00; C10M 125/22; C10M 2203/1006; C10M 2219/068; C10M 2207/1265; C10M 2215/064; C10M 2205/0285; C10M 2207/1285; C10M 2201/066; C10M 2203/065; C10M 2203/1065; C10M 2219/022; C10M 2201/065; C10M 2205/0206; C10M 2207/2805; C10M 2215/1026; C10N 2030/10; C10N 2050/10; C10N 2020/06; C10N 2040/046; C10N 2030/36; C10N 2030/06; C10N 2010/12; C10N 2010/02
See application file for complete search history.

(56) References Cited

FOREIGN PATENT DOCUMENTS

| | | | | |
|---|---|---|---|---|
| GB | 742547 | A | 12/1955 | |
| RU | 2061739 | C1 | 6/1996 | |
| WO | 9902629 | A1 | 1/1999 | |
| WO | 02077137 | A1 | 10/2002 | |
| WO | WO-2009121378 | A1 * | 10/2009 | ..... C10M 169/00 |

* cited by examiner

GREASE COMPOSITION INCLUDING COPPER SULFIDE FOR CONSTANT VELOCITY JOINTS

CROSS-REFERENCE TO RELATED APPLICATIONS

This application is a national stage of, and claims priority to, Patent Cooperation Treaty Application No. PCT/EP2019/075038, filed on Sep. 18, 2019, which application is hereby incorporated herein by reference in its entirety.

TECHNICAL FIELD

The present disclosure relates to a grease composition which is intended primarily for use in constant velocity joints (CV joints), especially ball joints and/or tripod joints, which are used in the drivelines of motor vehicles. Further, the present disclosure relates to a constant velocity joint comprising the grease composition in accordance with the present description.

BACKGROUND

Front-wheel drive cars have CV joints on both ends of the drive shafts (half shafts). Inner CV joints connect the drive shafts to the transmission. Outer CV joints connect the drive shafts to the wheels. Many rear-wheel drive and four-wheel drive cars as well as trucks have CV joints. CV joints or homokinetic joints allow the drive shaft to transmit power though a variable angle, at constant rotational speed, preferably without an appreciable increase in friction or play. In front-wheel drive cars, CV joints deliver the torque to the front wheels during turns.

There are two most commonly used types of CV joints: a ball-type and a tripod-type. In front-wheel drive cars, ball-type CV joints are used on the outer side of the drive shafts (outer CV joints), while the tripod-type CV joints mostly used on the inner side (inner CV joints). The motions of components within CV joints are complex with a combination of rolling and sliding. When the joints are under torque, the components are loaded together which can not only cause wear on the contact surfaces of the components, but also rolling contact fatigue and significant frictional forces between the surfaces.

CV joints also have sealing boots of elastomeric material which are usually of bellows shape, one end being connected to the outer part of the CV joint and the other end to the interconnecting or output shaft of the CV joint. The sealing boot retains the grease in the joint and keeps out dirt and water.

Not only must the grease reduce wear and friction and prevent the premature initiation of rolling contact fatigue in a CV joint, it must also be compatible with the elastomeric material of which the sealing boot is made. Otherwise there is a degradation of the sealing boot material which causes premature failure of the sealing boot, allowing the escape of the grease and ultimately failure of the CV joint. It is one of the most common problems with the CV joints when the protective sealing boot cracks or gets damaged. Once this happens, in addition to the escape of the grease, moisture and dirt get in, causing the CV joint to wear faster and eventually fail due to lack of lubrication and corrosion. Usually, outer CV joint sealing boots break first, as they have to endure more movement than the inner ones. If a CV joint itself is worn out, it cannot be repaired, it will have to be replaced with a new or reconditioned part. The two main types of material used for CV joint sealing boots are polychloroprene rubber (CR) and thermoplastic elastomer (TPE), especially ether-ester block co-polymer thermoplastic elastomer (TPC-ET).

Typical CV joint greases have base oils which are blends of naphthenic (saturated rings) and paraffinic (straight and branched saturated chains) mineral oils. Synthetic oils may also be added. It is known that said base oils have a large influence on the deterioration (swelling or shrinking) of both sealing boots made of CR and TPC-ET. Both mineral and synthetic base oils extract the plasticisers and other oil soluble protective agents from the sealing boot materials. Paraffinic mineral oils and poly-α-olefin (PAO) synthetic base oils diffuse very little into especially sealing boots, but on the other hand naphthenic mineral oils and synthetic esters diffuse into sealing boot materials like rubber and TPC-ET and act as plasticisers and can cause swelling. The exchange of plasticiser or plasticiser compositions for the naphthenic mineral oil can significantly reduce the sealing boot performance, especially at low temperatures, and may cause the sealing boot to fail by cold cracking, ultimately resulting in failure of the CV joint. If significant swelling or softening occurs, the maximum high-speed capability of the sealing boot is reduced due to the poor stability at speed and/or excessive radial expansion.

In order to solve the aforesaid problems, WO 99/02629 A1 suggests a special grease including a base oil comprising mineral or synthetic oils or mixtures thereof, a thickener, between 0.5 to 5% by weight of the total weight of the constituents of a molybdenum dithiophosphate (MoDTP) and between 0.5 to 5% by weight of the total weight of the constituents of powdered copper(I) oxide. In addition, the grease may include a molybdenum dithiocarbamate (MoDTC), a zinc dithiophosphate (ZnDTC), a metal-free sulphur-containing extreme pressure agent, an organic amine and, if desired, at least some of the usual additives such as corrosion inhibitors, anti-oxidant additives, tackiness agents and viscosity index improvers. The grease is economical in raw materials and has low wear and low friction characteristics. However, according to WO 99/02629 A1, the good wear and friction performance should be maintained by reducing early aging of sealing boot material caused by activated phosphorus. One had to admit that the improvement of the performance of the base oil with low wear and low friction characteristics achieved in WO 99/02629 A1 was a great accomplishment. Still there is a need of further enhancement due to the fact that the complex phosphorus-containing additives disclosed in the grease composition of WO 99/02629 A1 are reacting with the sealing boot material that leads to early aging which also may result in a premature failure of the sealing boot and further damage of the complete CV joint.

Like WO 99/02629 A1, most of the commercial CV joint lubricants contain organic phosphorus-containing additives, like zinc dialkyldithiophosphate (ZnDTP), which provides good anti-wear performance based on a tribochemical reaction on the metal surfaces of CV joints. The disadvantage especially of using phosphorus containing additives is that they show no good compatibility with sealing materials, especially sealing boots. Further on, molybdenum dithiophosphate (MoDTP) provide anti-wear and EP performance, in particular improved anti-friction properties at early running-times (run-in) of the CV joints. However, it is also known that molybdenum dithiophosphate (MoDTP) causes swelling and softening of the sealing boot material which may lead to an early aging of the complete sealing boot. These effects are based on the phosphorus which interacts with the sealing boot material and lead to early aging of the sealing boot material. Additionally, the phosphorus contained in mentioned organic metal salts is chemically more activated, thus having an even faster impact on the sealing boot material. In large quantities, the grease might therefore result in an early failure of the sealing boots used in CV joints.

If the negative properties are considered, it would certainly be advantageous to completely dispense with phosphorus-containing additives in order to increase the compatibility of the grease composition with the sealing boot material, while maintaining the overall lubricating properties, in order to achieve a longer lifetime of the entire CV joint.

It is the object of the present disclosure to provide for a grease composition, primarily for use in CV joints, which has a good compatibility with sealing boots made of rubber or thermoplastic elastomer, and which also gives enhanced endurance in the entire CV joint by maintaining good low wear and low friction coefficients.

SUMMARY

Said object is solved by a grease composition for use in CV joints, preferably with boots made of at least one TPE, further preferred made of at least one TPC-EP, comprising a) at least one base oil;

b) at least one thickener;

c) at least one copper sulfide in an amount of approximately 0.01 wt-% up to approximately 1.5 wt-%, the wt-% referring to the total amount of the grease composition; and d) molybdenum disulfide and/or at least one phosphorus-free organic molybdenum complex in an amount of approximately 0.1 wt-% up to approximately 5.0 wt-%, the wt-% referring to the total amount of the grease composition.

In addition to a grease composition, this disclosure relates to the use of a grease composition in accordance with the description herein in constant velocity joints. Further, the disclosure relates to a constant velocity joint comprising a grease composition in accordance with the description herein.

The advantage of the present composition for use in CV joints is that a combined formulation of at least one copper sulfide with molybdenum disulfide and/or at least one phosphorus-free organic molybdenum complex show a synergistic effect. Copper sulphide incorporates two main characteristics which are good EP performance, given by the sulphur, as well as anti-wear and reducing friction performance while the improved tribology is provided by the copper. Thereby, the included copper of the copper sulfide not only reduces wear as well as the friction coefficient, it is also considered to repair worn surfaces under high pressure which could lead to a prolonged lifetime of the metal compounds, i.e. the entire CV joint. Further on, it is proven that molybdenum disulfide as well as at least one phosphorus-free organic molybdenum complex reduces friction, provide anti-wear and enhance EP performance in grease composition. Further on, the use of phosphorus-containing additives, like ZnDTP, CuDTP or MoDTP, is not required. The mentioned synergistic effect is a higher lubrication performance at lower amounts of used additives which are also more compatible with the sealing material leading to lower wear and friction coefficient while elongating the lifetime of the CV joint. The inventors have found that the grease composition featuring a combination of copper sulfide with molybdenum disulfide and/or at least one phosphorus-free organic molybdenum complex effectively replaces the phosphorous-additives in the grease composition while enabling a longer lifetime of the entire CV joint, that may be proven for example by a Standard Multi Block Program (SMBP) test. In particular, the life endurance under heavy application of the CV joint, the oxidation stability of the lubricant, as well as the compatibility with CV joint sealing boot material are improved by the grease composition in accordance with the present disclosure.

Metal sulfides are featuring more stable bonds than in the case of organic metal salts, like ZnDTP or CuDTP, during mechanical shearing and heat. It is well known that organic metal salts decompose under heavy application into the inorganic salt and an organic radical. In contrast thereto, copper sulfide and molybdenum sulfide are stable phosphorus-free compounds without critical chemical activity inside the molecule under heavy application. Advantageously, the reaction of both sulfides with sealing boot material is minimized while the lubricating properties are maintained.

It is also advantageous that the grease composition requires less material in terms of additives. Due to the fact that molybdenum disulfide and/or at least one phosphorus-free molybdenum complex enhances the tribochemical properties of copper sulfide as a kind of a synergistic effect, the needed amounts of these additives are further reduced. The mentioned reduction of additive quantities also leads to a cost decrease in the production of the grease composition.

As far as the term weight percent or % by weight is used with respect to the components being comprised from the claimed grease composition, the term weight percent is referred to the amount of one or more components relative to the total amount of the grease composition throughout this specification, except where expressively stated otherwise. The expression "wt-%" is used throughout the present disclosure as an abbreviation for weight percent if not indicated otherwise.

In the context of this disclosure, the expressions "about" and "approximately" in connection with numerical values or ranges are to be understood as a tolerance range, which a person skilled in the art would consider as common or reasonable based on his or her general knowledge and in view of the disclosure as a whole. In particular, the expressions "about" and "approximately" refer to a tolerance range of ±20%, preferrably ±10% and further preferably ±5% with respect to the designated value. The lower end values and the upper end values of the various ranges, especially the weight percent ranges, but not restricted thereto, claimed in the present disclosure may be combined with each other in order to define new ranges.

Further, in the context of the present disclosure, all references to standards, norms, or standardization protocols, e.g., ISO, ASTM, etc., in connection with properties, numerical values or ranges referred to in to be understood as the latest updated version of said standard, norm, or standardization protocol being in force at the date of filing of this application.

DETAILED DESCRIPTION

Figure 1A:
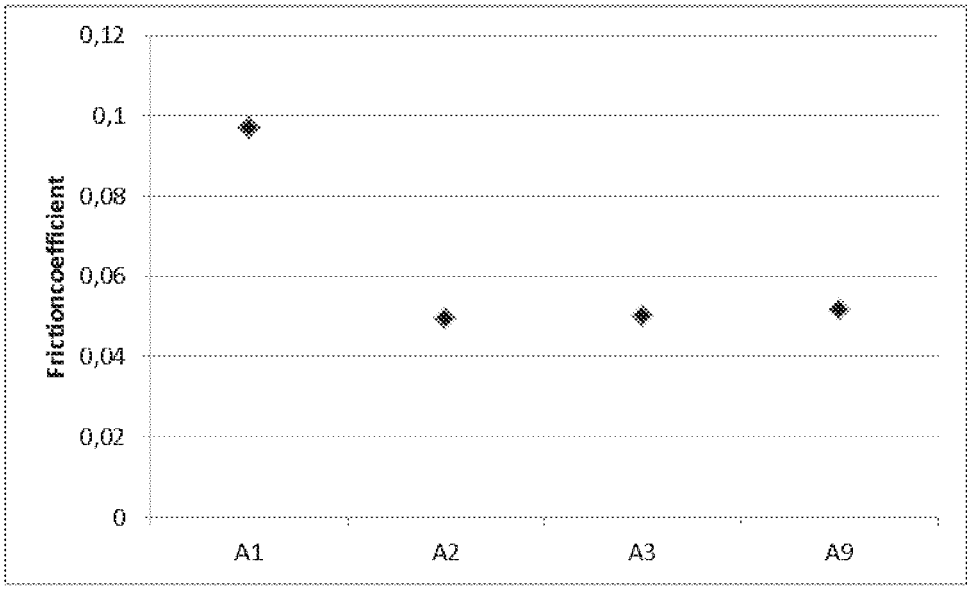
FIGS. 1*a* and 1*b* are plots of experimental results for friction and wear, respectively, for the additive effect of molybdenum disulfide in grease compositions.

A grease composition, primarily for use in constant velocity joints, preferably with boots made of at least one TPE, further preferably made of at least one TPC-EP, includes at least one base oil, at least one thickener, at least one copper sulfide, and molybdenum disulfide and/or at least one phosphorus-free organic molybdenum complex.

Preferably, the base oil used in the grease composition in accordance with the present disclosure comprises poly-α-olefines, napthenic oils, paraffinic oils, and/or synthetic organic esters. As a base oil according to the present disclosure, a base oil as disclosed in U.S. Pat. No. 5,670,461 A may preferably be used, the disclosure of which is incorporated insofar herein by reference. However, any further kind of base oil, especially a blend of mineral oils, a blend of synthetic oils or a blend of a mixture of mineral and synthetic oils may be used. The base oil should preferably have a kinematic viscosity of between approximately 32 and approximately 250 $mm^2/s$ at 40° C. and between approximately 5 and approximately 25 $mm^2/s$ at 100° C. The mineral oils preferably are selected from the group comprising at least one naphthenic oil and/or at least one paraffinic oil. The synthetic oils usable for the grease composition are selected from a group comprising at least one poly-α-olefin (PAO) and/or at least one naphthenic oil. The organic synthetic ester is preferably a di-carboxylic acid derivative having subgroups based on aliphatic alcohols. Preferably, the aliphatic alcohols have primary, straight or branched carbon chains with 2 to 20 carbon atoms. Preferably, the organic synthetic ester is selected from a group comprising sebacic acid-bis(2-ethylhexylester) ("dioctyl sebacate" (DOS)), adipic acid-bis-(2-ethylhexylester) ("dioctyl adipate" (DOA)), dioctyl phthalate (DOP) and/or azelaic acid-bis(2-ethylhexylester) ("dioctyl azelate (DOZ)). If poly-α-olefin is present in the base oil, the poly-α-olefin is preferably selected from a group comprised of 1-dodecene oligomer, 1-decene oligomer, 1-octene or a mixture thereof, and even more preferably a copolymer comprising 1-octene, poly-1-decene oligomer, poly-1-dodecene oligomer or a mixture thereof, wherein the poly-1-decene oligomer and the poly-1-dodecene oligomer could be dimeric, trimeric, tetrameric, pentameric or higher. Preferably, poly-α-olefins are selected having a kinematic viscosity in a range from approximately 2 to approximately 60 centistokes at 40° C. as defined in ASTM D445. The naphthenic oils selected for the base oil have preferably a kinematic viscosity in a range between approximately 3 to approximately 370 $mm^2/s$, more preferably approximately 20 to approximately 150 $mm^2/s$, at 40° C. If paraffinic oils were present in the base oil, preferably the paraffinic oils have a kinematic viscosity in a range between approximately 9 to approximately 170 $mm^2/s$ at 40° C.

The at least one base oil is preferably present in the grease composition in an amount of approximately 60 wt-% up to approximately 95 wt-%, and further preferred in an amount of approximately 63 wt-% up to approximately 93 wt-%, further preferred in an amount of approximately 75 wt-% up to approximately 92.5 wt-%, further preferred in an amount of approximately 78 wt-% up to approximately 92 wt-%, and even further preferred in an amount of approximately 79 wt-% up to approximately 92 wt-%, in each case referred to the total amount of the grease composition.

The at least one base oil may comprise at least one poly-α-olefin in an amount of approximately 20 wt-% up to approximately 40 wt-%, further preferred of approximately 25 wt % up to approximately 35 wt-%, and even further preferred in an amount of approximately 27 wt-% up to approximately 32 wt-%, in each case referred to the total amount of the base oil.

Further on, the at least one base oil may comprise at least one naphthenic oil in an amount approximately 60 wt-% up to approximately 80 wt-%, further preferred in an amount of approximately 65 wt-% up to approximately 75 wt-%, and even further preferred in an amount approximately 67 wt-% up to approximately 72 wt-%, in each case referred to the total amount of the base oil.

The term base oil as used in the present disclosure is understood in the sense that the base oil may also be a base oil composition comprising poly-α-olefines, naphthenic oils, paraffinic oils, and/or synthetic organic esters. Preferably the base oil composition comprises at least one poly-α-olefin and at least one naphthenic oil, whereat the amount of poly-α-olefin is approximately 10 wt-% up to approximately 60 wt-%, further preferred of approximately 20 wt % up to approximately 50 wt-%, and even further preferred approximately 27 wt-% up to approximately 32 wt-%, and whereat the amount of naphthenic oil is approximately 40 wt-% up to approximately 90 wt-%, further preferred approximately 50 wt-% up to approximately 80 wt %, and even further preferred approximately 67 wt-% up to approximately 72 wt-%, in each case the wt-% of poly-α-olefins and naphthenic oil referring to the total amount of the base oil.

The at least one thickener is preferably a lithium soap thickener and/or an urea thickener, of which the use of a lithium soap thickener is most preferred. A lithium soap thickener is a reaction product of at least one fatty acid with lithiumhydroxide. Preferably, the thickener may be a simple lithium soap formed from stearic acid, 12-hydroxy stearic acid, hydrogenated castor oil or from other similar fatty acids or mixtures thereof or methylesters of such acids. Alternatively, or additionally, a lithium complex soap may be used formed for example from a mixture of long-chained fatty acids together with a complexing agent, for example a borate of one or more dicarboxylic acids. The use of complex lithium soaps allows the grease composition to operate up to a temperature of about 180° C., whereas with simple lithium soaps, the grease composition will only operate up to a temperature of about 120° C. The urea thickener may be chosen among diurea compounds as well as polyurea compounds. For example, diurea compounds are selected from a group obtained through a reaction of monoamine with a diisocyanate compound such as phenylene diisocyanate, diphenyl diisocyanate, phenyl diisocyanate, diphenylmethane diisocyanate, octadecane diisocyanate, decane diisocyanate and hexane diisocyanate, examples of such monoamines are octylamine, dodecylamine, hexadecylamine, octadecylamine, oleylamine, aniline, p-toluidine, and cyclohexylamine; polyurea compounds are selected from a group obtained through a reaction of diamine with a diisocyante compound such as diisocyanates as mentioned above and diamines include ethylenediamine, propanediamine, butanediamin, hexanediamine, octanediamine, phenylenediamine, tolylenediamine, and xylenediamine; and/or urea thickeners are selected from a group obtained through a reaction of aryl amine such as p-toluidine or aniline, cyclohexyl amine or a mixture thereof with diisocyante. The aryl group of the diurea compound, if present, is preferably comprised of 6 or 7 carbon atoms. However, mixtures of all of the aforesaid thickeners such as lithium soap thickeners and urea thickeners may also be used. The at least one thickener is preferably present in an amount of approximately 2 wt-% up to approximately 20 wt-%, further preferred in an amount of approximately 4.0 wt-% up to approximately 17.0 wt-%, in each case the wt-% referring to the total amount of the grease composition.

The at least one copper sulfide is present in a solid state. Copper(II) sulfide (copper monosulfide, CuS) is preferred used over copper(I) sulfide (copper disulfide, $Cu_2S$). In nature, copper monosulfide occurs as the mineral Covellin. Copper disulfide occurs naturally as monoclinic crystallizing mineral Chalcosine, also known as copper luster, and the tetragonal crystallizing mineral Wuyanzhiite. Preferably, industrial produced copper sulfide powder is used, however, the crystalline structure is not further distinguished. In the grease composition, copper sulfide powder is preferably used over crystals, dispersions or even as solutions in water or ethanol. In the grease composition, copper(II) sulfide is preferably used as powder with a particle size $D_{90}$ of 19.9 μm measured by a CLIAS 1064 Nass regarding ISO 13320. Further on, the density at 20° C. is up to 4.6 g/cm$^3$. The used copper(I) sulfide preferably is powdered with a particle size D90 of 53.6 μm measured by a CLIAS 1064 Nass regarding ISO 13320. Further on, the density at 20° C. is up to 5.5 g/cm$^3$. The at least one copper sulfide is present in an amount of approximately 0.01 wt-% up to approximately 1.5 wt-%, further preferred in an amount of approximately 0.1 wt-% up to approximately 1.0 wt-%, in each case the wt-% referring to the total amount of the grease composition.

The grease composition comprises molybdenum disulfide and/or at least one phosphorus-free molybdenum complex. Molybdenum disulfide (molybdenum(IV) sulfide, $MoS_2$) is preferably used over molybdenum(VI) sulfide ($MoS_3$) and/or molybdenum(V) sulfide ($Mo_2S_5$). In the grease composition, molybdenum disulfide super fine powder is preferably used over crystals, dispersions or even as solutions in water or ethanol. The preferred used super fine molybdenum disulfide powder has a purity of 97 wt-%, further preferred a Fisher number of 0.40 up to 0.50 μm, even further preferred a particle size distribution $D_{90}$ of 7.0 am by laser diffraction instrument, Microtrac X100$^2$ with the standardization of ISO 13320, and a bulk density of 0.4 g/cm$^3$. To protect molybdenum disulfide of oxidation, preferably an antioxidation agent might be used. The at least one phosphorus-free molybdenum complex is preferred a molybdenum dithiocarbamate (MoDTC). MoDTC is preferably of the following general formula (1):

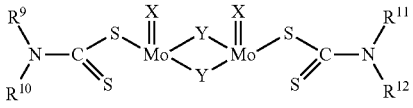

(I)

wherein X or Y represents S or O and each of R9 to R12 inclusive may be the same or different and each represents a primary (straight chain) or secondary (branched chain) alkyl group having between 3 and 20 carbon atoms. The at least one phosphorus-free molybdenum complex is present as solid MoDTC.

Preferably, the phosphorus-free molybdenum complex may be present in the grease composition of which phosphorus-free molybdenum complex comprising sulfur are preferred. The grease composition preferably contains one or more of MoDTCs in the solid state, but also may contain at least one MoDTC in the solid state and at least one MoDTC in the liquid state. In an example, the composition does not contain any phosphorous-containing molybdenum compounds. The molybdenum disulfide and/or at least one phosphorus-free molybdenum complex is present in an amount of approximately 0.1 wt-% up to approximately 5.0 wt-%, further preferred in an amount of approximately 1.0 wt-% up to approximately 3.0 wt-%, in each case referred to the total amount of the grease composition. Molybdenum disulfide and/or at least one phosphorus-free molybdenum complex is present in an amount (in wt-%) relative to the total amount (in wt-%) of copper sulfide, also in combination with each other, in a range between approximately 1:1 to approximately 15:1, preferably in a range between approximately 3:1 to approximately 10:1. The total amount of the at least one copper sulfide, of molybdenum disulfide and/or at least one phosphorus-free molybdenum complex is approximately 6.5 wt-% at the most, and further preferred approximately 0.5 wt-% up to approximately 6.0 wt-%, in each case the wt-% referring to the total amount of the grease composition.

It is also possible to include in the grease composition various known additives such as anti-oxidation agents, anti-rust agents, other extreme-pressure (EP) modifier agents, anti-wear agents and oil-improvers. Preferably comprised in the grease composition are the grease additives mentioned in the following. The present grease composition is preferably a phosphorus-free formulation in the sense that also all additives are phosphorus-free additives.

In a further example, at least one sulphur containing EP modifier agent, in the following description referred to as organic sulphur-additive, is comprised containing at least 10 wt-% sulphur, the wt-% referring to the total amount of organic sulphur-additive. For the purposes of this disclosure, ZnDTP and MoDTP are not considered to be encompassed by the term organic sulphur-additives. In a further example, the organic sulphur-additive is selected from a group comprising at least one olefin sulfide, alkyl thiadiazole, or a combination thereof. The olefin sulfide may comprise olefin monomers of ethylene, propylene, butane-1 and/or 4-methylpentene. The alkyl thiadiazole may comprise thiadiazole monomers of 1,2,3-thiadiazole, 1,2,4-thiadiazole, 1,2,5-thiadiazole and/or 1,3,4-thiadiazole. The at least one organic sulphur-additive is preferably present in an amount of approximately 0.2 wt-% up to approximately 1.0 wt-%, further preferred in an amount of approximately 0.3 wt-% up to approximately 0.7 wt-%, in each case the wt-% referring to the total amount of the grease composition. The at least one organic sulphur-additive comprises sulphur in an amount of at least 20 wt-%, and even more preferred between approximately 20 wt-% up to approximately 70 wt-%, the wt-% referring to the total amount of organic sulphur-additive.

In a further example, at least one anti-oxidation agent is present in the grease composition. As an anti-oxidation agent, the grease composition may comprise an amine, preferably an aromatic amine, more preferably benzamine and/or N-phenyl compounds reacted with 2,4,4-trimethylpentene or derivatives thereof. The anti-oxidation agent is used to prevent deterioration of the grease composition associated with oxidation. The grease composition may comprise at least one anti-oxidation agent in a range between approximately 0.1 wt-% to approximately 2 wt-%, the wt-% referring to the total amount to the grease composition, in order to inhibit the oxidation degradation of the base oil and/or molybdenum disulfide, as well as to lengthen the life of the grease composition, thus prolonging the life of the CV joint. The at least one anti-oxidation agent is preferably present in an amount of approximately 0.1 wt-% up to approximately 2.0 wt-%, further preferred in an amount of approximately 0.2 wt-% up to approximately 1.5 wt-%, in each case the wt-% referring to the total amount of the grease composition.

Further, the present disclosure refers to the use of a grease composition in accordance with the present description in CV joints, and, further, to a CV joint comprising a grease composition as described. The CV joint especially encompasses a sealing boot, the boot being filled with the grease composition, at least in part, the sealing boot having a first attachment region which is assigned to a joint, and a second attachment region which is assigned to a shaft. The sealing boot may be fixed with usual clamp devices on the joint and/or shaft.

In an example, a grease composition is defined comprising approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, and approximately 0.2 wt % to approximately 1.0 wt-% of at least one organic sulphur-additive, in each case the wt-% referring to the total amount of the grease composition.

In a further example, the grease composition is defined comprising approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one base oil comprises poly-α-olefins and/or naphthenic oils and/or paraffinic oils and/or synthetic organic esters.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereas the at least one base oil preferably comprises at least one poly-α-olefin in an amount of approximately 20 wt-% up to approximately 40 wt-%, the wt-% referring to the total amount of the base oil, whereat the poly-α-olefin is a 1-decene oligomer and even more preferred a poly-1-decene comprised of a defined mixture of decen-trimer, decen-tetramer, decen-pentamer or higher oligomers.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one base oil comprises of at least one naphthenic oil in an amount approximately 60 wt-% up to approximately 80 wt-%, the wt-% referring to the total amount of the base oil, whereat the naphthenic oil is preferably selected from a group comprising saturated cyclic alkanes.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one thickener is selected from a group comprising lithium soap thickener and urea thickener, preferably the lithium soap thickener is a reaction product of at least one fatty acid with lithiumhydroxide and the urea thickener is at least one compound of diurea and/or polyurea.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, both of said molybdenum containing additives preferably in a solid state, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one copper sulfide is preferably comprised as copper(II) sulfide (CuS) in a solid state.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the molybdenum disulfide and/or at least one phosphorus-free organic molybdenum complex is comprised in a solid state.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one phosphorus-free molybdenum complex is preferably a molybdenum dithiocarbamate (MoDTC) in the solid state.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, whereat the total amount of at least one copper sulfide, of molybdenum disulfide and/or at least one phosphorus-free organic molybdenum complex is approximately 6.5 wt-% at the most, and further preferred approximately 0.1 wt-% up to approximately 6.0 wt-%, the wt-% referring to the total amount of the grease composition.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one organic sulphur-additive comprises sulphur in an amount of at least 20 wt-%, and even more preferred between approximately 20 wt-% up to approximately 70 wt-%, the wt-% referring to the total amount of the organic sulfur additive, and whereat the organic sulphur-additive is preferably selected from a group comprising at least one alkyl thiadiazole or an olefin sulfide made up of reaction products with olefin monomers as ethylene, propylene, butane-1 and/or 4-methylpentene.

In a further example, the grease composition comprises approximately 60 wt-% to approximately 95 wt-% of at least one base oil, approximately 2 wt-% to approximately 20 wt-% of at least one thickener, approximately 0.01 wt-% to approximately 1.5 wt-% of at least one copper sulfide, approximately 0.1 wt-% to approximately 5.0 wt-% of molybdenum disulfide and/or at least one phosphorus-free organic molybdenum complex, approximately 0.2 wt-% to approximately 1.0 wt-% of at least one organic sulphur-additive, and approximately 0.1 wt-% to approximately 2.0 wt-% of at least one anti-oxidation agent, in each case the wt-% referring to the total amount of the grease composition, whereat the at least one anti-oxidation agent is preferably an amine, more preferably aromatic amines, even more preferably benzamine and/or N-phenyl compounds reacted with 2,4,4-trimethylpentene or derivatives thereof.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one base oil comprises of poly-α-olefins and/or naphthenic oils and/or paraffinic oils and/or synthetic organic esters.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one base oil preferred comprises of at least one poly-α-olefin in an amount of approximately 20 wt-% up to approximately 40 wt-%, the wt-% referring to the total amount of the base oil, whereat the poly-α-olefin preferably is selected from a group comprised of 1-dodecene oligomer, 1-decene oligomer, 1-octene or a mixture thereof, and even more preferably a copolymer comprising 1-octene, poly-1-decene oligomer, poly-1-dodecene oligomer or a mixture thereof, wherein the poly-1-decene oligomer and the poly-1-dodecene oligomer could be dimeric, trimeric, tetrameric, pentameric or higher.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one base oil comprises of at least one naphthenic oil in an amount approximately 60 wt-% up to approximately 80 wt-%, the wt-% referring to the total amount of the base oil, whereat the naphthenic oil is preferably selected from a group comprising saturated cyclic alkanes.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one thickener is selected from a group comprising lithium soap thickener and an urea thickener, preferably the lithium soap thickener is a reaction product of at least one fatty acid with lithiumhydroxide and the urea thickener is at least one compound of diurea and/or polyurea.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, both of said molybdenum containing additives preferably in a solid state, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one copper sulfide is preferably comprised as copper(II) sulfide (CuS) in a solid state.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one phosphorus-free molybdenum complex is preferred a molybdenum dithiocarbamate (MoDTC).

In a further example, the grease composition comprises approximately 79 wt-% to approximately 92 wt-% of at least one base oil, approximately 6 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the molybdenum disulfide and/or at least one phosphorus-free organic molybdenum complex is comprised in a solid state.

In a further example, the grease composition comprises approximately 79 wt-% to approximately 92 wt-% of at least one base oil, approximately 4 wt-% to approximately 17 wt % of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1.

In a further example, the grease composition comprises approximately 79 wt-% to approximately 92 wt-% of at least one base oil, approximately 4 wt-% to approximately 17 wt % of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one organic sulphur-additive comprises sulphur in an amount of at least 20 wt-%, and even more preferred between approximately 20 wt-% up to approximately 70 wt-%, the wt-% referring to the total amount of the organic sulphur-additive, and whereat the organic sulphur-additive is preferably selected from a group comprising at least one alkyl thiadiazole or an olefin sulfide made up of reaction products with olefin monomers as ethylene, propylene, butane-1 and/or 4-methylpentene.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one anti-oxidation agent is preferably an amine, more preferably an aromatic amine, even more preferably benzamine and/or N-phenyl compounds reacted with 2,4,4-trimethylpentene or derivatives thereof.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one base oil is selected from a group comprising poly-α-olefins and/or naphthenic oils and/or paraffinic oils and/or synthetic organic esters, whereat the at least one base oil preferably comprises of at least one poly-α-olefin in an amount of approximately 10 wt-% up to approximately 60 wt-%, the wt-% referring to the total amount of the base oil, whereat the poly-α-olefin is preferably selected from a group comprised of 1-dodecene oligomer, 1-decene oligomer, 1-octene or a mixture thereof, and even more preferably a copolymer comprising 1-octene, poly-1-decene oligomer, poly-1-dodecene oligomer or a mixture thereof, wherein the poly-1-decene oligomer and the poly-1-dodecene oligomer could be dimeric, trimeric, tetrameric, pentameric or higher, whereat the at least one base oil preferably comprises of at least one naphthenic oil in an amount approximately 40 wt-% up to approximately 90 wt-%, the wt-% referring to the total amount of the base oil, whereat the naphthenic oil is preferably selected from a group comprising saturated cyclic alkanes.

In a further example, the grease composition comprises approximately 79 wt-% to approximately 92-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one copper sulfide is preferably comprised as copper(II) sulfide (CuS) in a solid state, whereat the molybdenum disulfide and/or at least one phosphorus-free organic molybdenum complex is comprised in a solid state, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, and whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition, whereat the at least one phosphorus-free molybdenum complex is preferred a molybdenum dithiocarbamate (MoDTC).

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one organic sulphur-additive comprises sulphur in an amount of at least 20 wt-%, and even more preferred between approximately 20 wt-% up to approximately 70 wt-%, the wt-% referring to the total amount of the organic sulphur-additive, and whereat the organic sulphur-additive is preferably selected from a group comprising at least one alkyl thiadiazole or an olefin sulfide made up of reaction products with olefin monomers as ethylene, propylene, butane-1 and/or 4-methylpentene, and whereat the at least one anti-oxidation agent is preferably an amine, more preferably an aromatic amine, even more preferably benzamine and/or N-phenyl compounds reacted with 2,4,4-trimethylpentene or derivatives thereof.

In a further example, the grease composition comprises approximately 79 wt-% to approximately 92 wt-% of at least one base oil, approximately 4 wt-% to approximately 17 wt-% of at least one thickener, approximately 0.1 wt-% to approximately 1.0 wt-% of at least one copper sulfide, approximately 1.0 wt-% to approximately 3.0 wt-% of molybdenum disulfide and/or at least one phosphorus-free organic molybdenum complex, approximately 0.3 wt-% to approximately 0.7 wt-% of at least one organic sulphur-additive, and approximately 0.2 wt-% to approximately 1.5 wt-% of at least one anti-oxidation agent, in each case the wt-% referring to the total amount of the grease composition, whereat the at least one base oil comprises poly-α-olefins and/or naphthenic oils and/or paraffinic oils and/or synthetic organic esters, whereat the at least one base oil preferably comprises at least one poly-α-olefin in an amount of approximately 10 wt-% up to approximately 60 wt-%, the wt-% referring to the total amount of the base oil, whereat the poly-α-olefin preferably is selected from a group comprised of 1-dodecene oligomer, 1-decene oligomer, 1-octene or a mixture thereof, and even more preferably a copolymer comprising 1-octene, poly-1-decene oligomer, poly-1-dodecene oligomer or a mixture thereof, wherein the poly-1-decene oligomer and the poly-1-dodecene oligomer could be dimeric, trimeric, tetrameric, pentameric or higher, whereat the at least one base oil comprises at least one naphthenic oil in an amount approximately 40 wt-% up to approximately 90 wt-%, the wt-% referring to the total amount of the base oil, whereat the naphthenic oil is preferably selected from a group comprising saturated cyclic alkanes, whereat the at least one thickener is selected from a group comprising lithium soap thickener and urea thickener, whereby the lithium soap thickener is preferably a reaction product of at least one fatty acid with lithiumhydroxide and the urea thickener is preferably at least selected from a group consisting of diurea and/or polyurea, whereat at least one copper sulfide, molybdenum disulfide and/or at least one phosphorus-free molybdenum complex are preferably in a solid state, whereat the grease composition comprises preferably copper (II) sulfide (CuS), whereat the at least one phosphorus-free molybdenum complex is preferably a molybdenum dithiocarbamate (MoDTC), whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, and whereat the total amount of the at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition, whereat the at least one organic sulphur-additive comprises sulphur in an amount of at least 20 wt-%, even more preferred between approximately 20 wt-% up to approximately 70 wt-%, the wt-% referring to the total amount of the organic sulphur-additive, whereat the organic sulphur-additive is preferably selected from a group consisting of at least one alkyl thiadiazole or an olefin sulfide made up of reaction products with olefin monomers as ethylene, propylene, butane-1 and/or 4-methylpentene, whereat the at least one anti-oxidation agent is preferably an amine, more preferably an aromatic amine, even more preferably benzamine and/or N-phenyl compounds reacted with 2,4,4-trimethylpentene or derivatives thereof.

In a further example, a grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1.

In a further example, a grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, of molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition.

In a further example, a grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, of molybdenum disulfide and/or at least one phosphorus-free organic molybdenum complex is approximately 6.5 wt-% at the most, and further preferred approximately 0.1 wt-% up to approximately 6.0 wt-% relative to the total amount of the composition, characterized in that the at least one copper sulfide is comprised in an amount of approximately 0.01 wt-% up to approximately 1.5 wt-%, in each case the wt-% referring to the total amount of the grease composition.

In a further example, the grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, characterized in that the molybdenum disulfide and/or at least one phosphorus-free molybdenum compound is comprised in an amount of approximately 0.1 wt-% up to approximately 5.0 wt-%, in each case the wt-% referring to the total amount of the grease composition.

In a further example, the grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, whereat the at least one organic sulphur-additive is comprised in an amount of approximately 0.2 wt-% up to approximately 1.0 wt-%, in each case the wt-% referring to the total amount of the grease composition, and whereat the at least one organic sulphur-additive comprises sulphur in an amount of at least 20 wt-%, the wt-% referring to the total amount of the organic sulphur-additive.

In a further example, the grease composition for use in CV joints comprises at least one base oil, at least one simple or complex soap thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, of molybdenum disulfide and/or at least one phosphorus-free organic molybdenum complex is approximately 6.5 wt-% at the most, and further preferred approximately 0.1 wt-% up to approximately 6.0 wt-%, whereat the at least one anti-oxidation agent is comprised in an amount of approximately 0.1 wt-% up to approximately 2.0 wt-%, in each case the wt-% referring to the total amount of the grease composition.

In a further example, the grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, whereat the at least one thickener is selected from a group comprising lithium soap thickener and urea thickener, whereat the at least one thickener is comprised in an amount of approximately 4 wt-% up to approximately 20 wt-%, in each case the wt-% referring to the total amount of the grease composition.

In a further example, the grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition, whereat the at least one base oil comprises poly-α-olefines, naphthenic oils, paraffinic oils, and/or synthetic organic esters.

In a further example, the grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range between approximately 1:1 to approximately 15:1, preferably in a range between approximately 3:1 to approximately 10:1, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition, whereat the at least one base oil comprises at least one poly-α-olefin in an amount of approximately 10 wt-% up to approximately 60 wt-%, the wt-% referring to the total amount of the base oil, and/or whereat the at least one base oil comprises at least one naphthenic oil in an amount of approximately 40 wt-% up to approximately 90 wt-%, the wt-% referring to the total amount of the base oil.

In a further example, the grease composition for use in CV joints comprises at least one base oil, at least one thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range preferably between approximately 3:1 to approximately 10:1, whereat the total amount of at least one copper sulfide, molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition.

In a further example, the grease composition for use in CV joints comprises at least one base oil, at least one simple or complex soap thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%)

relative to the total amount (in wt-%) of at least one copper sulfide, also in combination with each other, in a range preferably between approximately 1:1 to approximately 10:1, whereat the total amount of at least one copper sulfide, of molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition.

In a further example, the grease composition for use in CV joints comprises at least one base oil, at least thickener, at least one copper sulfide, molybdenum disulfide and/or at least one phosphorus-free molybdenum complex, at least one organic sulphur-additive, and at least one anti-oxidation agent, whereat the molybdenum disulfide and/or at least one phosphorus-free organic molybdenum complex is present in an amount (in wt-%) relative to the total amount (in wt-%) of at least one copper sulfide, also in combination with each other, in a range preferably between approximately 3:1 to approximately 15:1, whereat the total amount of at least one copper sulfide, of molybdenum disulfide and/or at least one phosphorus-free organic molybdenum complex is approximately 6.5 wt-% at the most, and further preferred approximately 0.1 wt-% up to approximately 6.0 wt-%, in each case the wt-% referring to the total amount of the grease composition.

The above-mentioned examples of the grease composition are non-limiting preferred examples whereby different combination of the said ranges and additives are also possible.

The grease composition will be hereunder being described in more detail with reference to the following non-limiting examples and comparative examples of various grease compositions.

In order to determine the effect of lowering the friction coefficient as well as the wear by the grease composition, Schwingungs-Reibverschleiß SRV tests are carried out using an Optimol Instruments SRV tester. Flat disc lower specimen made of the 100Cr6 standard bearing steel from Optimol Instruments Prüftechnik GmbH, Westendstrasse 125, Munich, properly cleaned using a solvent are prepared and contacted with the grease composition to be examined. The SRV test is an industry standard test and is especially relevant for the testing of greases for CV joints. The test consists of an upper ball specimen with a diameter of 10 mm made from 100Cr6 bearing steel reciprocating under load on the flat disc lower specimen indicated above. In tests for mimicking tripod joints a frequency of 40 Hz with an applied load of 500 N were applied for 60 minutes (including running-in) at 80° C. The stroke was 1.5 mm. The friction coefficients obtained were recorded on computer. For each grease composition, the reported value is an average of two data at the end of tests in two runs. For the running-in measurement of the friction coefficient, it is started with an applied load of 50 N for 1 minute under the above-specified conditions. Afterwards, the applied load is increased for 30 seconds by 50 N up to 500 N. Wear is measured using a profilometer and a digital planimeter. By using the profilometer, a profile of the cross section in the middle of the worn surfaces can be obtained. The area (S) of this cross section can be measured by using the digital planimeter. The wear quantity is assessed by V=SI, where V is the volume of the wear and I is the stroke. The wear rate (Wr) is obtained from Wr=V/L [$\mu m^3/m$], where L is the total sliding distance in the tests.

A Standard Multi Block Program SMBP Test is used to compare and evaluate the life endurance characteristics of CV joints. A CV joint is exposed to a torque at an acceleration rate of 250 Nm/sec, a jounce deflection at a rate of 100 mm/sec and a rotation speed at an acceleration rate of at least 40 rpm/sec to maximum values of at least 1000 Nm and 2000 rpm. During the program, a permanent record of the actual torque, speed and jounce deflection (angle) will be given by a test rig. The program will run defined load cycles until the CV joint gets a first sign of significant impairments. One cycle is defined by 51.3 min and 39973 revolutions. The life endurance is evaluated by the accomplished cycles until failure of the CV joint. A failure is defined as an overproportioned temperature increase or appearance of noises indicating wear. The CV joint life endurance is valuated by the number of accomplished cycles until the failure of the CV joint. For better statistical power up to 4 CV joint containing the same grease composition are tested simultaneously. When 4 out of 4 CV joints failed, the testing is completed and the overall cycles are counted. As comparison a commercial grease is used.

Further, tests regarding the compatibility properties of a thermoplastic elastomer sealing boot, i.e. Pibiflex B5050 MWR, carried out with a grease composition as described herein and with one commercial grease, i.e. commercial grease composition B1 (see Table 1), were carried out with respect to the change of hardness (shore D) and the percentage change of tensile, elongation, and volume before and after a heat aging of the sealing boot material immersed in the grease at 125° C. for 336 hours. Said values are measured in accordance with ISO 868 (shore D), ISO 37 (tensile change and elongation change), and ISO 2781 (volume change).

The base oil as used for grease compositions A1 to A10 consists of a poly-α-olefin in an amount of 83 wt-% up to 84 wt-% and a naphthenic oil in an amount of 16 wt-% up to 17 wt-%, in each case the wt-% referring to the total amount of the base oil.

The following compounds indicated as following were used in the grease compositions of Table 1. Commercial grease B1 comprises a base oil, at least one anti-oxidation agent, at least one organic sulphur-additive and 8% by weight of Li-soap thickener and is produced by. As Copper (II) sulfide (CuS) powder having a particle size $D_{90}$ 19.9 μm was used. Copper(II) sulfide obtainable as CB 500 from Tribotecc GmbH, Kearntner Str. 7, 1010 Vienna, Austria was used. Copper (1) sulfide ($Cu_2S$) powder having a particle size $D_{90}$ of 53.6 μm was used. Copper(I) sulfide obtainable as CB 300 from Tribotecc GmbH, Kearntner Str. 7, 1010 Vienna, Austria was used. As Molybdenum disulfide ($MoS_2$) powder having a purity of 97 wt-% and a particle size of 0.40 up to 0.50 μm was used. As a phosphorus-free molybdenum complex Molybdenum dithiocarbamte (MoDTC), obtainable under the commercial name Sakuralube 600 from Adeka, was used. As an organic sulphur-additive, Anglamol 99 from Lubrizol France, 25 Quai de France, 76173 Rouen Cedex, France was used. As an anti-oxidation agent, Irganox L57 from BASF SE, 67056 Ludwigshafen, Germany was used. As a Li soap thickener, Lithiumstearate obtained by reaction of 12-hydroxystearic acid with Lithiumhydroxide (LiOH).

Commercial grease is designated as B1 and the grease composition comprising molybdenum disulfide are designated as A1 to A7, A9 and A10, whereas the grease composition designated A8 is a comparative sample:

TABLE 1

| [wt %] | B1 | A1 | A2 | A3 | A4 | A5 | A6 | A7 | A8 | A9 | A10 |
|---|---|---|---|---|---|---|---|---|---|---|---|
| Base oil | yes | 88.5 | 86.5 | 88.0 | 89.0 | 88.0 | 87.0 | 88.0 | 88.00 | 87.5 | 87.5 |
| Li-Soap | 8 | 8 | 8 | 8 | 8 | 8 | 8 | 8 | 8 | 8 | 8 |
| Anti-oxidation agent | yes | 1.0 | 1.0 | 1.0 | 1.0 | 1.0 | 1.0 | 1.0 | 1.0 | 1.0 | 1.0 |
| CuS | — | 0.5 | 0.5 | 0.5 | 0.5 | 0.5 | 0.5 | 0.5 | — | 0.5 | — |
| $Cu_2S$ | — | — | — | — | — | — | — | — | — | — | 0.5 |
| $MoS_2$ | 2.5 | — | 0.2 | 0.5 | 1.0 | 1.0 | 1.0 | 1.0 | 1.0 | 1.0 | 1.0 |
| MoDTC | — | 1.5 | 1.5 | 1.5 | — | 1.0 | 2.0 | 1.5 | 1.5 | 1.5 | 1.5 |
| organic sulphur-additive | yes | 0.5 | 0.5 | 0.5 | 0.5 | 0.5 | 0.5 | — | 0.5 | 0.5 | 0.5 |

Figure 1B:
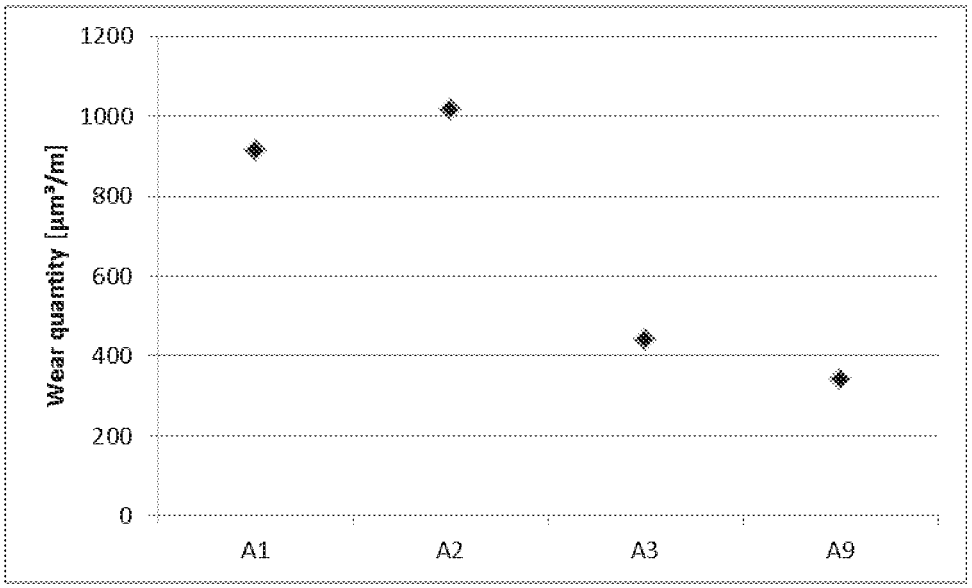
Figure 2A:
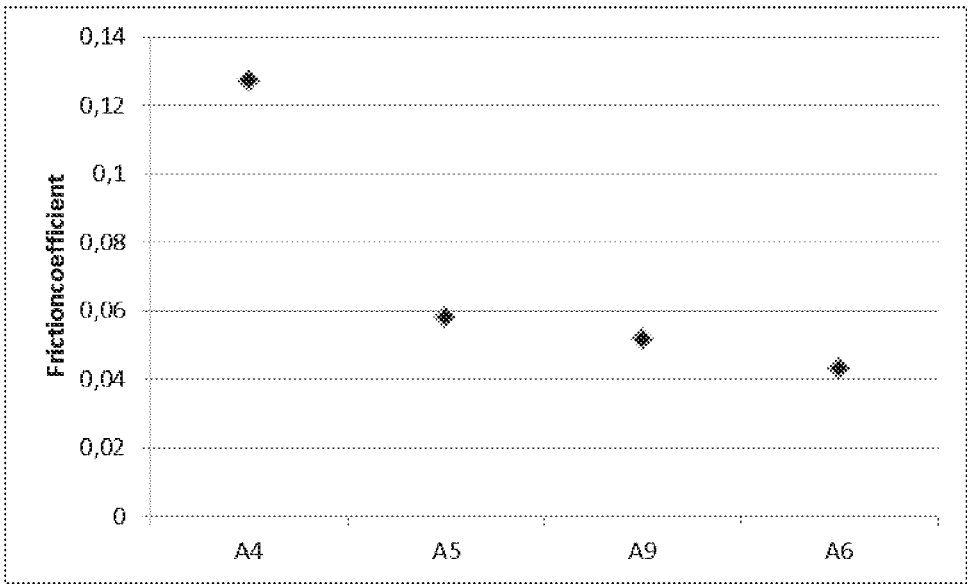
FIGS. 2*a* and 2*b* are plots of experimental results for friction and wear, respectively, for the additive effect of molybdenum dithiocarbamate (MoDTC) in grease compositions.
Figure 2B:
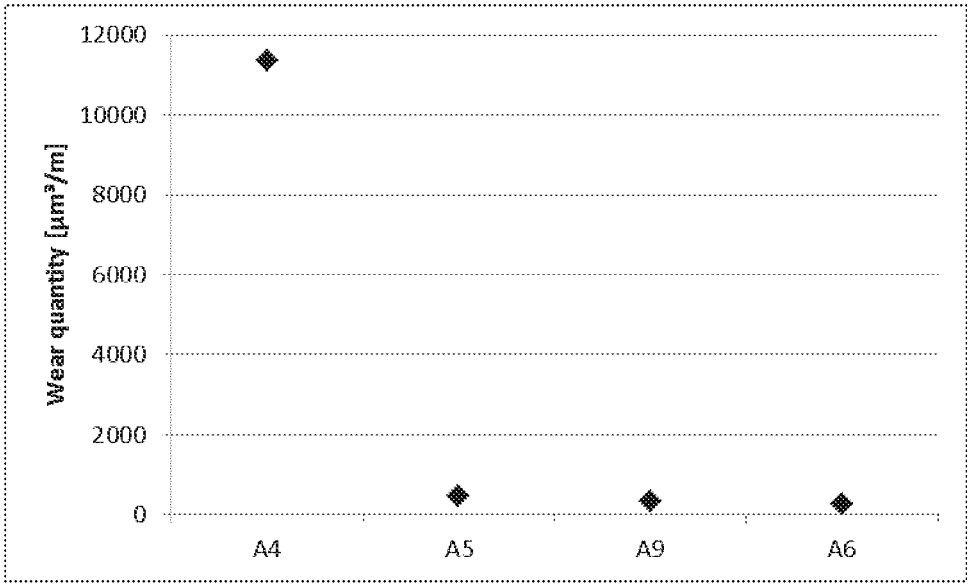
Figure 3A:
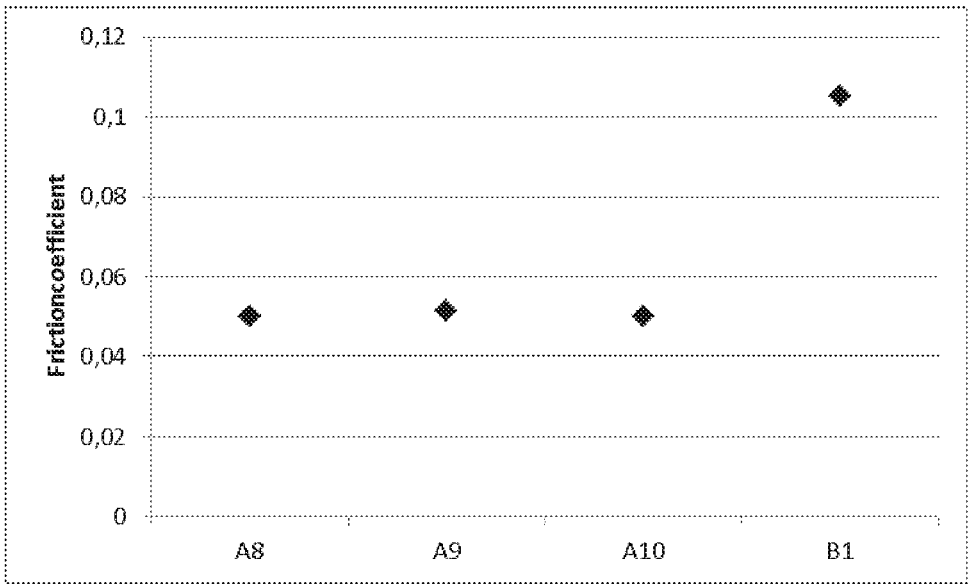
FIGS. 3*a* and 3*b* are plots of experimental results for friction and wear, respectively, for the additive effects of copper(II) sulfide (CuS) and copper(I) sulfide ($Cu_2S$) of the grease compositions according to this disclosure in comparison with a commercial grease.
Figure 3B:
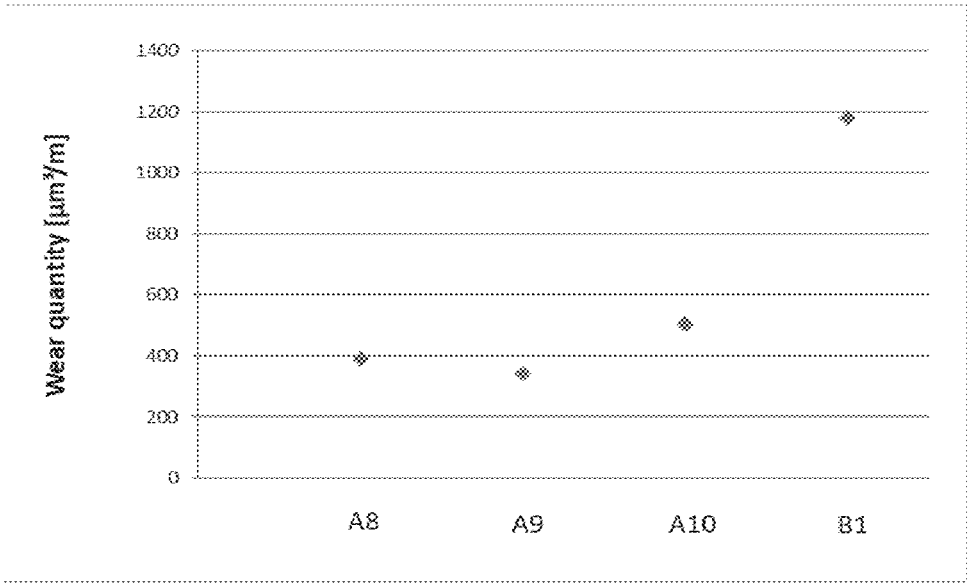
Figure 4A:
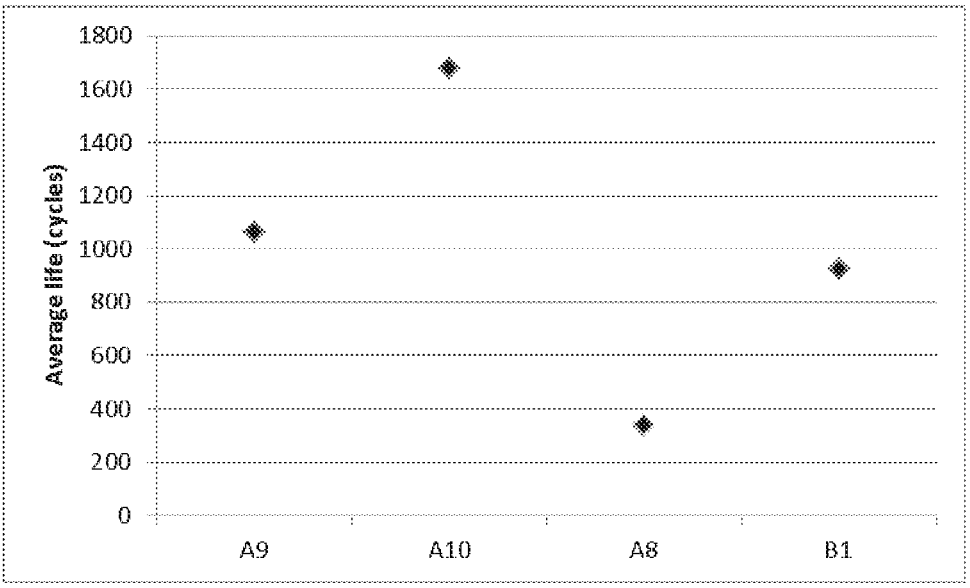
FIGS. 4*a* and 4*b* are plots of experimental results for a compatibility test of sealing boot material and a life endurance of a CV joint with the grease compositions.
Figure 4B:
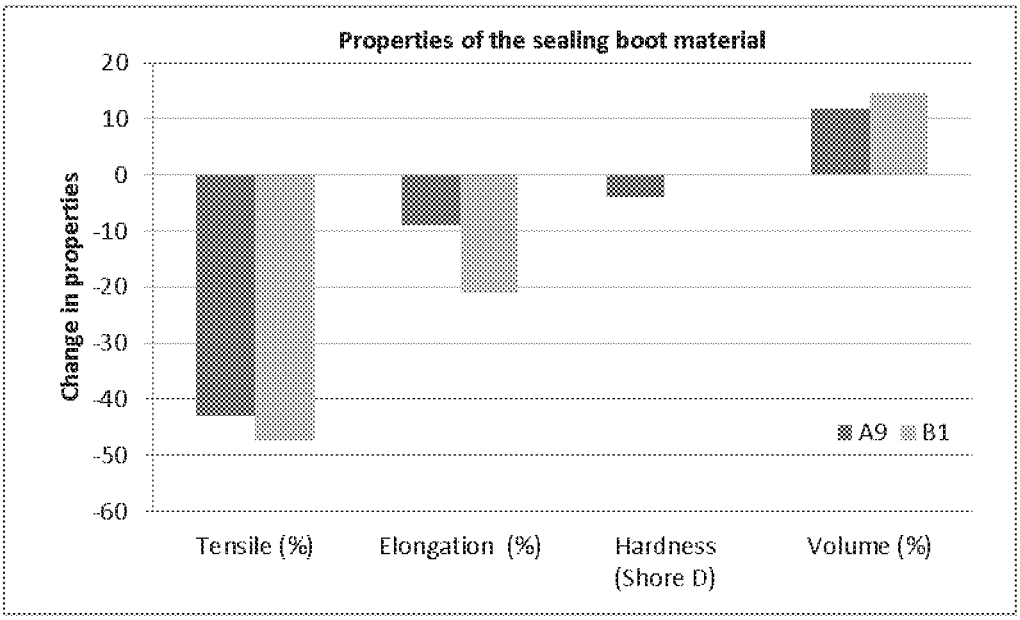

Experimental values for friction, wear, boot compatibility and life endurance (SMBP test) are presented in Table 2 and FIGS. 1*a*, 1*b*, 2*a*, 2*b*, and 3. The Figures show:

FIGS. 1*a* and 1*b*: Experimental results for friction and wear, respectively, as presented in Table 2, are shown for the additive effect of molybdenum disulfide in compositions A1 to A3 in comparison with grease composition A9;

FIGS. 2*a* and 2*b*: Experimental results for friction and wear, respectively, as presented in Table 2, are shown for the additive effect of molybdenum dithiocarbamate (MoDTC) in A4 to A6 in comparison with grease composition A9;

FIGS. 3*a* and 3*b*: Experimental results for friction and wear, respectively, as presented in Table 2, are shown for the additive effects of copper(II) sulfide (CuS) and copper(I) sulfide ($Cu_2S$) of the grease compositions A9 and A10 in comparison with the commercial grease B1 and a copper-free grease composition A8;

FIGS. 4*a* and 4*b*: Experimental results, as presented in Table 3, for the compatibility test of sealing boot material and the life endurance of a CV joint of the grease compositions A9 and A10 in comparison with the commercial grease B1.

Experimental results regarding the friction coefficient and wear quantity of the grease compositions A1 to A7, A9 and A10 compared to grease composition A8 and commercial grease B1 are presented in Table 2.

TABLE 2

| [wt %] | Commercial grease B1 | A1 | A2 | A3 | A4 | A5 | A6 | A7 | A8 | A9 | A10 |
|---|---|---|---|---|---|---|---|---|---|---|---|
| CuS | — | 0.5 | 0.5 | 0.5 | 0.5 | 0.5 | 0.5 | 0.5 | — | 0.50 | — |
| $Cu_2S$ | — | — | — | — | — | — | — | — | — | — | 0.5 |
| $MoS_2$ | 2.5 | — | 0.2 | 0.5 | 1.0 | 1.0 | 1.0 | 1.0 | 1.0 | 1.0 | 1.0 |
| MoDTC | — | 1.5 | 1.5 | 1.5 | — | 1.0 | 2.0 | 1.5 | 1.5 | 1.5 | 1.5 |
| Friction coefficient | 0.105 | 0.097 | 0.0495 | 0.05 | 0.127 | 0.058 | 0.043 | 0.138 | 0.05 | 0.0515 | 0.052 |
| Wear quantity [$\mu m^3/m$] | 1181 | 915 | 1016 | 439 | 11349 | 469 | 273 | 11151 | 391 | 340 | 503 |

Table 2 and FIGS. 1*a* and 1*b* show the experimental results of the grease composition A9 in comparison with grease compositions A1 to A3. A1 comprises 1.5 wt-% of molybdenum dithiocarbamate (MoDTC), 0.5 wt-% of copper(II) sulfide (CuS) and 0.5 wt-% of organic sulphur-additive without molybdenum disulfide. By adding 0.2 wt-% molybdenum disulfide in A2, a reduction of the friction coefficient to about 0.05 is observed, while the wear quantity remains at about 1000 $\mu m^3/m$. By stepwise increasing of the molybdenum disulfide in A3 and the grease composition A9 quantity, the friction coefficient remains at 0.05 by simultaneously improving the wear quantity to about 400 $\mu m^3/m$.

Table 2 and FIGS. 2*a* and 2*b* show the experimental results of the grease composition A9 in comparison with grease compositions A4 to A6. A4 comprises 1.0 wt-% of molybdenum disulfide, 0.5 wt-% of copper(II) sulfide (CuS) and 0.5 wt-% of organic sulphur-additive without molybdenum dithiocarbamate (MoDTC). A4 shows a high friction coefficient of about 0.12 as well as a high wear quantity at about 11000 $\mu m^3/m$. Adding 1.0 wt-% of molybdenum dithiocarbamate (MoDTC) into the grease composition like in A5 results in a considerable reduction of the friction coefficient to about 0.6 as well as a reduction of the wear quantity to about 440 $\mu m^3/m$. The stepwise increase of molybdenum dithiocarbamate (MoDTC) in A6 and A9 leads to a further reduction of both the friction coefficient and the wear quantity.

In conclusion, the experimental data shown in FIGS. 1*a*, 1*b*, 2*a* and 2*b* prove a synergistic effect using molybdenum disulfide and molybdenum dithiocarbamate (MoDTC) with copper(II) sulfide (CuS) in a grease formulation. The tribology performance is significantly improved by only combining all three components molybdenum disulfide, molybdenum dithiocarbamate (MoDTC) and copper(II) sulfide (CuS).

Table 2 and FIGS. 3*a* and 3*b* show the grease tribology performance influenced by copper(II) sulfide (CuS) and copper(I) sulfide ($Cu_2S$) additives in the grease compositions A9 and A10 in comparison to the commercial grease B1 and a copper-free grease formulation A8. The greases A9 and A10 show improved friction coefficient and wear quantity in comparison with the commercial grease B1.

Experimental results regarding the endurance of the grease composition with CV joints and compatibility of the grease composition with sealing boot materials as compared to commercial grease B1 are presented in Table 3.

TABLE 3

| | | B1 | A8 | A9 | A10 |
|---|---|---|---|---|---|
| Endurance SMBP Test | CuS | — | — | 0.5 | — |
| | $Cu_2S$ | — | — | — | 0.5 |
| | $MoS_2$ | yes | 1.0 | 1.0 | 1.0 |
| | MoDTC | — | 1.5 | 1.5 | 1.5 |
| | organic sulphur-additive | yes | 0.5 | 0.5 | 0.5 |
| | Life endurance | 925 | 339 | 1061 | 1676 |

TABLE 3-continued

| | | B1 | A8 | A9 | A10 |
|---|---|---|---|---|---|
| Compatibility Test for sealing boot material | Tensile change [%] | −47 | n.d. | −43 | n.d. |
| | Elongation change [%] | −21 | n.d. | −9 | n.d. |
| | Hardness change [Shore D] | 0 | n.d. | −4 | n.d. |
| | Volume change [%] | 15 | n.d. | 12 | n.d. |

n.d.—not detected

Table 3 and FIG. 4*a* show the experimental results of the CV joints tested with the grease compositions A9 and A10 in the SMBP test for the average life of the CV joints in comparison with the copper-free grease composition A8 and the commercial grease B1. Both grease compositions A9 and A10 show a considerable improvement of life endurance. The positive impact of copper(II) sulfide (CuS) and copper (I) sulfide ($Cu_2S$) is shown in comparison with the copper-free grease composition A8.

Table 3 and FIG. 4*b* show the experimental results of compatibility test of the sealing boot material (Pibiflex B 5050 MWR) of a CV joint with the grease composition A9 and the commercial grease B1. The grease composition A9 shows a slight improvement of the tensile strength, an improvement in elongation and volume properties.

The examples of the grease compositions clearly demonstrate that the combination of at least one copper sulfide and molybdenum disulfide retains the general lubricating properties of the grease composition, but in addition increases the compatibility with the sealing boot material as well as the life endurance of the CV joint.

The invention claimed is:

1. A grease composition for use in constant velocity joints comprising a) at least one base oil;

b) at least one thickener;

c) at least one copper sulfide in an amount between approximately 0.01 wt % and approximately 1.5 wt-% of a total amount of the grease composition; and d) molybdenum disulfide and molybdenum dithiocarbamate together in an amount between approximately 0.1 wt-% and approximately 5.0 wt-% of the total amount of the grease composition.

2. The grease composition of claim 1, wherein the at least one copper sulfide is copper(II)sulfide (CuS).

3. The grease composition of claim 1, wherein a ratio between the amount of the molybdenum disulfide and molybdenum dithiocarbamate together and the amount of the at least one copper sulfide is in a range between approximately 1:1 to approximately 15:1.

4. The grease composition of claim 1, wherein a total amount of the at least one copper sulfide and the molybdenum disulfide and molybdenum dithiocarbamate together is less than or equal to approximately 6.5 wt-% of the total amount of the grease composition.

5. The grease composition of claim 1, further comprising at least one organic sulfur-additive in an amount between approximately 0.2 wt-% and approximately 1.0 wt-% of the total amount of the grease composition.

6. The grease composition of claim 5, wherein the at least one organic sulfur-additive comprises sulphur in an amount of at least approximately 20 wt-% of the amount of the at least one organic sulfur-additive.

7. The grease composition of claim 1, wherein the at least one thickener is selected from a group consisting of at least one urea thickener, at least one lithium soap and at least one lithium complex soap.

8. The grease composition of claim 1, further comprising at least one anti-oxidation agent in an amount between approximately 0.1 wt-% and approximately 2.0 wt-% of the total amount of the grease composition.

9. The grease composition of claim 1, wherein the at least one base oil comprises at least one of poly-α-olefins, naphthenic oils, paraffinic oils, or synthetic organic esters.

10. The grease composition of claim 1, wherein the at least one base oil comprises at least one poly-α-olefin in an amount between approximately 10 wt-% and approximately 60 wt-% of the amount of the base oil.

11. The grease composition of claim 1, wherein the at least one base oil comprises at least one naphthenic oil in an amount between approximately 40 wt-% and approximately 90 wt-% of the amount of the base oil.

12. The grease composition of claim 1, further comprising:

at least one organic sulfur additive in an amount between approximately 0.2 wt-% and approximately 1.0 wt-% of the total amount of the grease composition; and at least one anti-oxidation agent in an amount between approximately 0.1 wt-% and approximately 2.0 wt-% of the total amount of the grease composition;

wherein the at least one base oil is in an amount between approximately 60 wt-% and approximately 95 wt-% of the total amount of the grease composition; and the at least one thickener is in an amount between approximately 2 wt-% and approximately 20 wt-% of the total amount of the grease composition.

13. A method comprising:

providing a grease composition comprising:

a) at least one base oil;

b) at least one thickener;

c) at least one copper sulfide in an amount between approximately 0.01 wt-% and approximately 1.5 wt-% of a total amount of the grease composition; and d) molybdenum disulfide and molybdenum dithiocarbamate together in an amount between approximately 0.1 wt-% and approximately 5.0 wt-% of the total amount of the grease composition filling a constant velocity joint with the grease composition.

14. A constant velocity joint comprising:

a grease composition comprising:

a) at least one base oil;

b) at least one thickener;

c) at least one copper sulfide in an amount between approximately 0.01 wt-% and approximately 1.5 wt-% of a total amount of the grease composition; and d) molybdenum disulfide and molybdenum dithiocarbamate together in an amount between approximately 0.1 wt-% and approximately 5.0 wt-% of the total amount of the grease composition.

15. The grease composition of claim 1, wherein the molybdenum disulfide and the molybdenum dithiocarbamate together is in an amount between approximately 1.0 wt-% and approximately 3.5 wt-% of the total amount of the grease composition.

16. The grease composition of claim 1, wherein the at least one copper sulfide is in an amount between approximately 0.1 wt-% and 1.0 wt-% of the total amount of the grease composition, and the molybdenum disulfide and molybdenum dithiocarbamate together is in an amount between approximately 1.0 wt-% and approximately 3.0 wt-% of the total amount of the grease composition.

17. The grease composition of claim 1, wherein the at least one copper sulfide is in an amount between approximately 0.3 wt-% and 0.7 wt-% of the total amount of the grease composition, and the molybdenum disulfide and molybdenum dithiocarbamate together is in an amount between approximately 1.5 wt-% and approximately 3.0 wt-% of the total amount of the grease composition.

* * * * *